US011622607B2

(12) United States Patent
Imbriani

(10) Patent No.: US 11,622,607 B2
(45) Date of Patent: Apr. 11, 2023

(54) NECKLACE FOR LOTIONS AND GELS

(71) Applicant: Sun Tube, LLC, St. Petersburg, FL (US)

(72) Inventor: Ralph Imbriani, St. Petersburg, FL (US)

( * ) Notice: Subject to any disclaimer, the term of this patent is extended or adjusted under 35 U.S.C. 154(b) by 472 days.

(21) Appl. No.: 16/920,466

(22) Filed: Jul. 3, 2020

(65) Prior Publication Data

US 2022/0000225 A1 Jan. 6, 2022

(51) Int. Cl.

| | |
|---|---|
| ***A44C 15/00*** | (2006.01) |
| ***A45D 40/18*** | (2006.01) |
| ***A45D 40/00*** | (2006.01) |

(52) U.S. Cl.

CPC ..... *A44C 15/002* (2013.01); *A45D 40/18* (2013.01); *A45D 2040/0012* (2013.01)

(58) Field of Classification Search

CPC .... A44C 15/002; A44C 15/005; A45D 40/18; A45D 2040/0012; A45D 34/00; A45D 2034/007; A46B 11/0041; A46B 11/0044

USPC ..... 222/206, 212, 386; 401/6, 183–186

See application file for complete search history.

(56) References Cited

U.S. PATENT DOCUMENTS

| | | | | |
|---|---|---|---|---|
| 4,221,495 | A | 9/1980 | Braun | |
| 4,768,688 | A | 9/1988 | Harrigan | |
| 5,244,135 | A | 9/1993 | Nelson | |
| 5,622,293 | A | 4/1997 | LeFevre | |
| 6,581,811 | B1 | 6/2003 | Schillaci | |
| 7,766,193 | B2 | 8/2010 | Stollmann | |
| 8,708,194 | B2 | 4/2014 | Pascatore | |
| 8,950,632 | B2 | 2/2015 | Ciavarella | |
| 9,693,607 | B2 | 7/2017 | Imbriani | |
| 9,944,111 | B2 * | 4/2018 | Elmore | B43K 23/00 |
| 10,123,607 | B1 * | 11/2018 | Hardy | A45D 40/261 |

* cited by examiner

*Primary Examiner* — David J Walczak

(74) *Attorney, Agent, or Firm* — Larson & Larson; Justin P. Miller; Frank Liebnow

(57) ABSTRACT

The improved necklace for lotions and gels for lotions and gels is a device that allows a user to transport and dispense sunscreen. The device is intended to be worn as a necklace or bracelet. The device includes two internal storage locations separated by a moveable plug. Movement of the plug allows for alteration of the size of the chambers, as well as helping a user to push sunscreen, or other liquids and gels, out of the desired chamber.

11 Claims, 6 Drawing Sheets

NECKLACE FOR LOTIONS AND GELS

FIELD

This invention relates to the field of personal storage of cosmetics and lotions—more particularly to a device for the storage and transportation of personal qualities of sunscreen.

BACKGROUND

According to the Skin Cancer Foundation, skin cancer rates are increasing. Skin cancer affects many Americans—over the past three decades, more Americans were diagnosed with skin cancer than with all other cancers combined.

Using sunscreen is the best-known way to prevent skin cancer. Research shows that regular use of sunscreen decreases the risk of skin cancer by 40-50 percent.

While using sunscreen to reduce the chance of skin cancer is simple, carrying sunscreen is impractical. A backpack is not always available to store the sunscreen bottle. This is particularly true when at a water park, public pool, or beach.

Additionally, there is a need to carry other liquids or gels for application to the hands and skin.

What is needed is a device that will allow a user to easily carry sunscreen or other liquids/gels.

SUMMARY

The improved necklace for lotions and gels is a device that allows a user to transport and dispense sunscreen and other liquids or gels.

The device is intended to be worn as a necklace or bracelet. The device includes two internal storage locations separated by a moveable plug. Movement of the plug allows for alteration of the size of the chambers, as well as helping a user to push sunscreen out of the desired chamber.

The primary embodiment of the device is shaped as a long tube or elongated reservoir. This facilitates wearing the device as a necklace or bracelet. Optionally included in the wall of the tube is a filament, shape-retaining member/filament, or wire. The filament is a material that allows the user to bend the device to fit around the neck or wrist, and allows the device to maintain the desired shape. Anticipated materials include steel, aluminum, and other metals. But certain plastics may also be suitable for use.

Alternatively, the wire is included in an extension of the wall. This allows for the wall of the sunscreen chambers to be thin enough to be readily squeezed, without creating a wall that is too thin for the wire to be placed.

Alternatively, the body has two wall thicknesses: a thin section primarily surrounding the sunscreen chambers, the thin section being readily squeezable; and a thicker section within which the wire is embedded.

The primary embodiment of the long tube includes two openings, one on each end—a proximal opening and a distal opening. Affixed to each opening is a dispensing cap. The dispensing cap prevents the sunscreen from exiting the device while it is worn, but allows the user to access the sunscreen when needed.

The tube can be made of many flexible materials that a user can squeeze to compress, thus moving the internal plug. Included are plastic, silicone rubber, natural rubber, neoprene, polyurethane, nylon, and related materials.

Further options include color. The tubing may be clear or translucent, allowing a user to view the contents. Or the tubing may be opaque. If the tubing is other than clear, colors may be chosen as desired for branding purposes, or to denote different types of enclosed product. For example, yellow may be used for sunscreen with a rating of SPF 15 and red for sunscreen with a rating of SPF 30. Or if the device is filled with liquids other than sunscreen, one may use colors to indicate contents. For example, blue for hand lotion and green for shampoo.

The disclosed device is anticipated as a single-use item, or as a refillable item.

As a single-use item, the device is sold prefilled with sunscreen. Optional color-coding is applied to indicate the strength of the contained sunscreen. The device contains a quantity of sunscreen required by a single user for a day of sun exposure. The item is purchased, used throughout the day, and discarded when empty.

As a refillable item, the device may be sold with or without contained sunscreen. The user may refill the device by removing the dispensing cap and forcing sunscreen back into the device. In this embodiment color-coding may be inappropriate, given that the user may fill the device with any strength of sunscreen.

While the preferred embodiment contains sunscreen, alternative embodiments contain other liquids or gels. For example, face cream, hand lotion, paint, condiments such as ketchup or mustard, soap, shampoo, and so forth.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
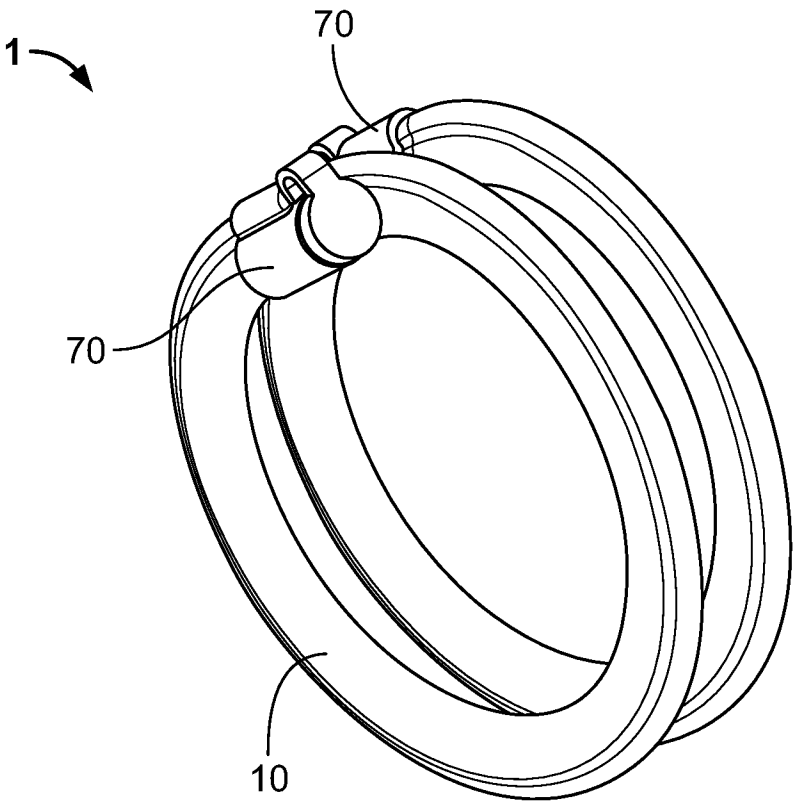
FIG. 1 illustrates a coiled view of the improved necklace for lotions and gels.

Reference will now be made in detail to the presently preferred embodiments of the invention, examples of which are illustrated in the accompanying drawings. Throughout the following detailed description, the same reference numerals refer to the same elements in all figures.

Referring to FIG. 1, a coiled view of the improved necklace for lotions and gels is shown.

The sunscreen storage device 1 is shown with body 10 terminated by caps 70.

Figure 2:
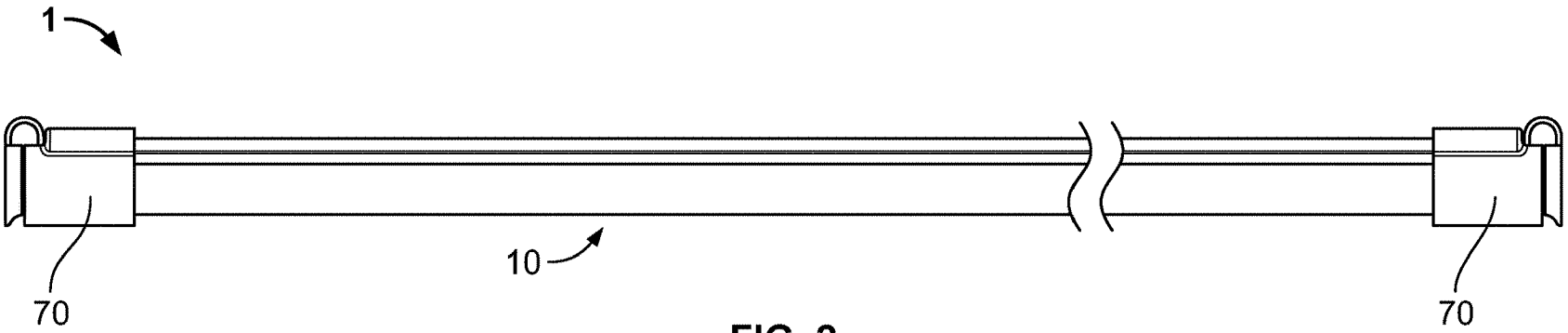
FIG. 2 illustrates a side extended view of the improved necklace for lotions and gels.
Figure 3:
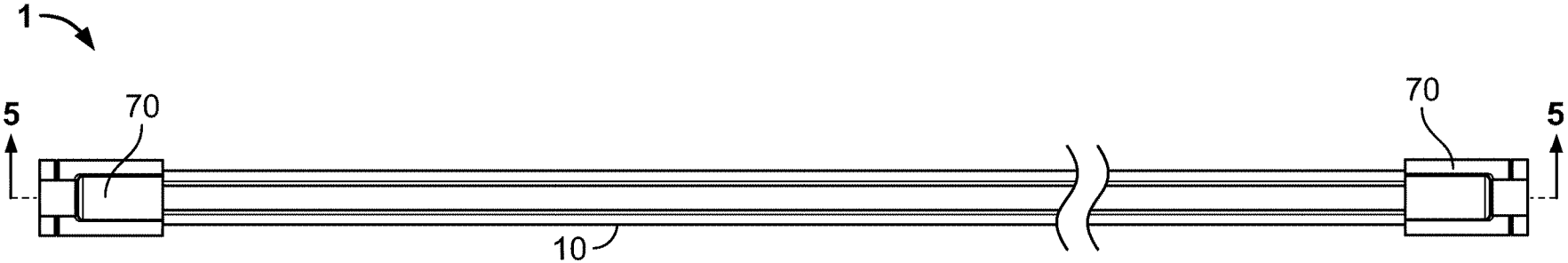
FIG. 3 illustrates a top extended view of the improved necklace for lotions and gels.

Referring to FIGS. 2 and 3, a side extended view and top extended view of the improved necklace for lotions and gels are shown.

Again, the sunscreen storage device 1 is shown with body 10 terminated by caps 70.

Figure 4:
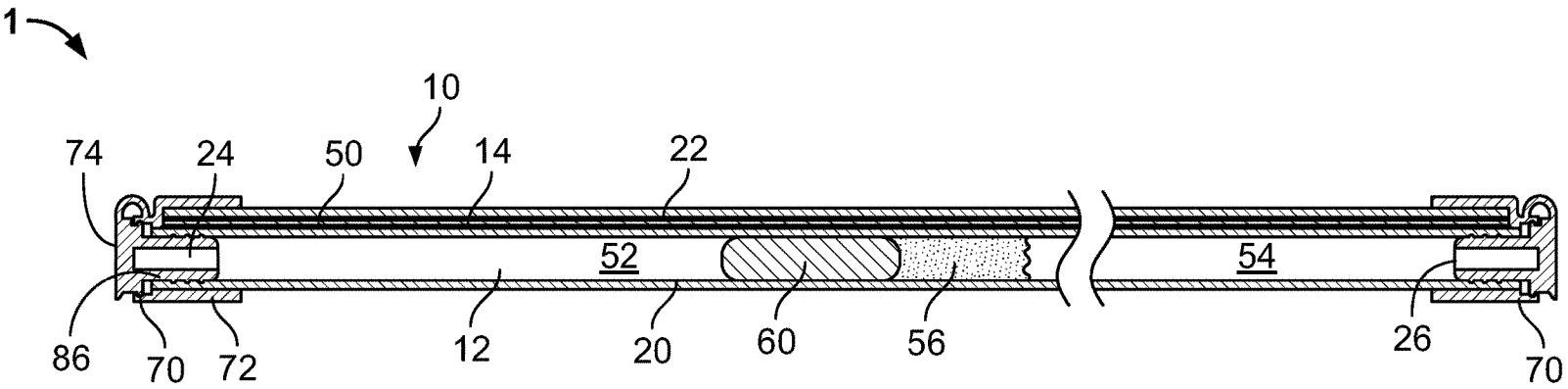
FIG. 4 illustrates a longitudinal cross-sectional view of the improved necklace for lotions and gels.

Referring to FIG. 4, a longitudinal cross-sectional view of the improved necklace for lotions and gels is shown.

The sunscreen storage device 1 includes a body 10 that forms a sunscreen section 12 and a wire-retaining section 14.

The hole through the sunscreen section 12 is referred to as the sunscreen bore 20, with the hole through the wire-retaining section 14 referred to as the wire bore 22. A shape retaining wire 50 is held within the wire bore 22.

The proximal opening 24 and distal opening 26 terminate in caps 70 with bodies 72 and lids 74, the caps 70 including nipples 86 that partially pass into the sunscreen bore 20, thus affixing the caps 70 to the body 10.

The nipples 86 also block the expelling plug 60 from being accidentally pushed out of the sunscreen storage device 1. If a user wishes to remove the expelling plug 60, a cap 70 is removed, opening the end of the sunscreen bore 20.

An expelling plug 60 within the sunscreen bore 20 separates the first sunscreen reservoir 52 from the second sunscreen reservoir 54. By squeezing the sunscreen section 12, a user is able to push the expelling plug 60 from one end to the other, thus forcing sunscreen 56 out through a cap 70.

Figure 5:
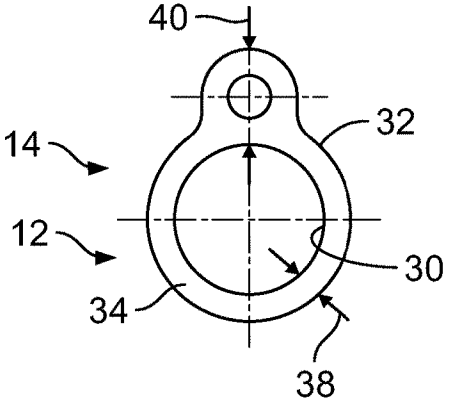
FIG. 5 illustrates a slice of the improved necklace for lotions and gels.

Referring to FIG. 5, a slice of the improved necklace for lotions and gels is shown.

The inner surface 30 and outer surface 32 form a wall 34. The wall 34 has a thinner portion, or squeezable wall thickness 38, where the user is to squeeze the sunscreen storage device 1 to cause motion of the expelling plug 60 (see FIG. 4).

A more robust reinforced wall thickness 40 joins the sunscreen section 12 to the wire-retaining section 14.

Figure 6:
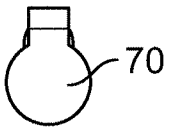
FIG. 6 illustrates an end view of the improved necklace for lotions and gels.

Referring to FIG. 6, an end view of the improved necklace for lotions and gels is shown.

The cap 70 is shown.

Figure 8:
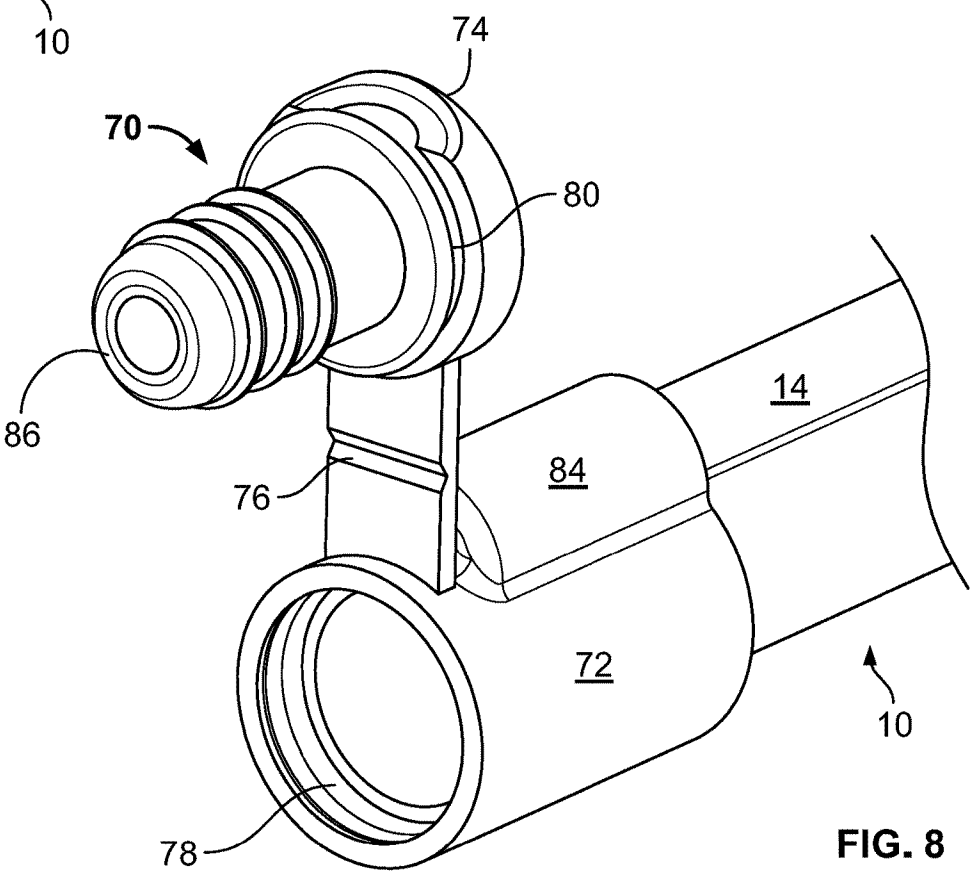
FIG. 8 illustrates a first view of an open cap of the improved necklace for lotions and gels.
Figure 7:
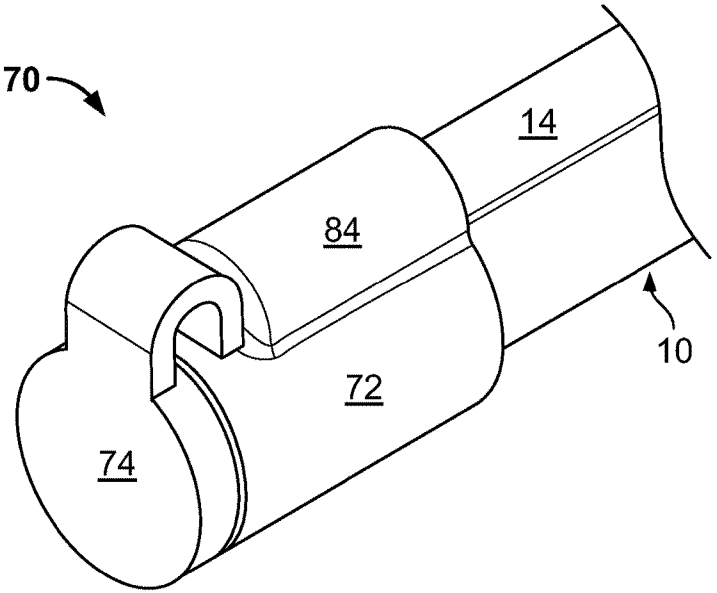
FIG. 7 illustrates a first view of a closed cap of the improved necklace for lotions and gels.

Referring to FIGS. 7 and 8, views of a closed and open cap of the improved necklace for lotions and gels are shown.

The dispensing cap 70 includes a body 72, joined to a lid 74 via hinge 76. The inside of the body 72 includes a recess 78, into which a rib 80 locks, holding the lid 74 in a closed position.

A hump 84 in body 72 allows for enclosure of the larger wire-retaining section 14 of the body 10.

Figure 9:
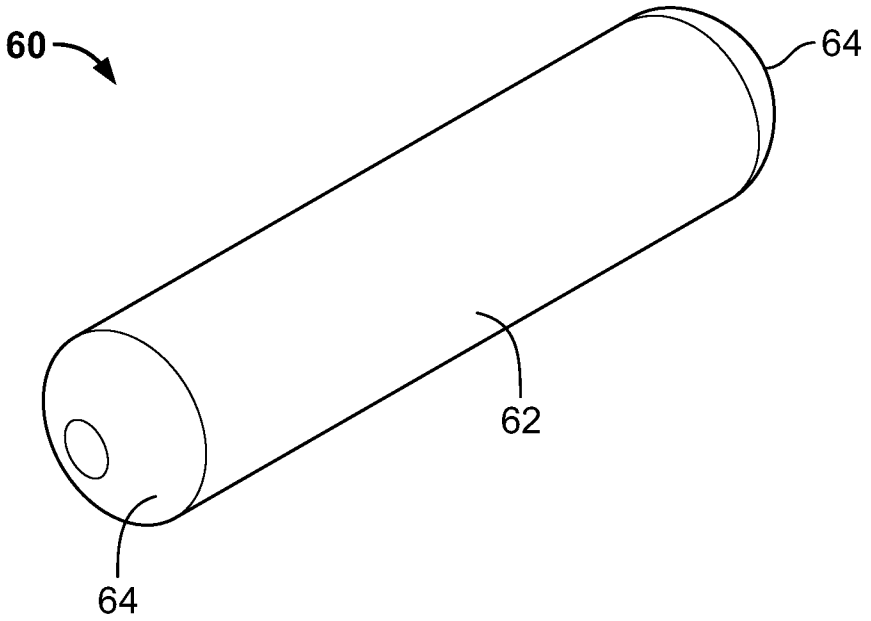
FIG. 9 illustrates a view of the expelling plug of the improved necklace for lotions and gels.

Referring to FIG. 9, a view of the expelling plug of the improved necklace for lotions and gels is shown.

The expelling plug 60 is formed form a plug body 62 and tapered plug ends 64.

Figure 10:
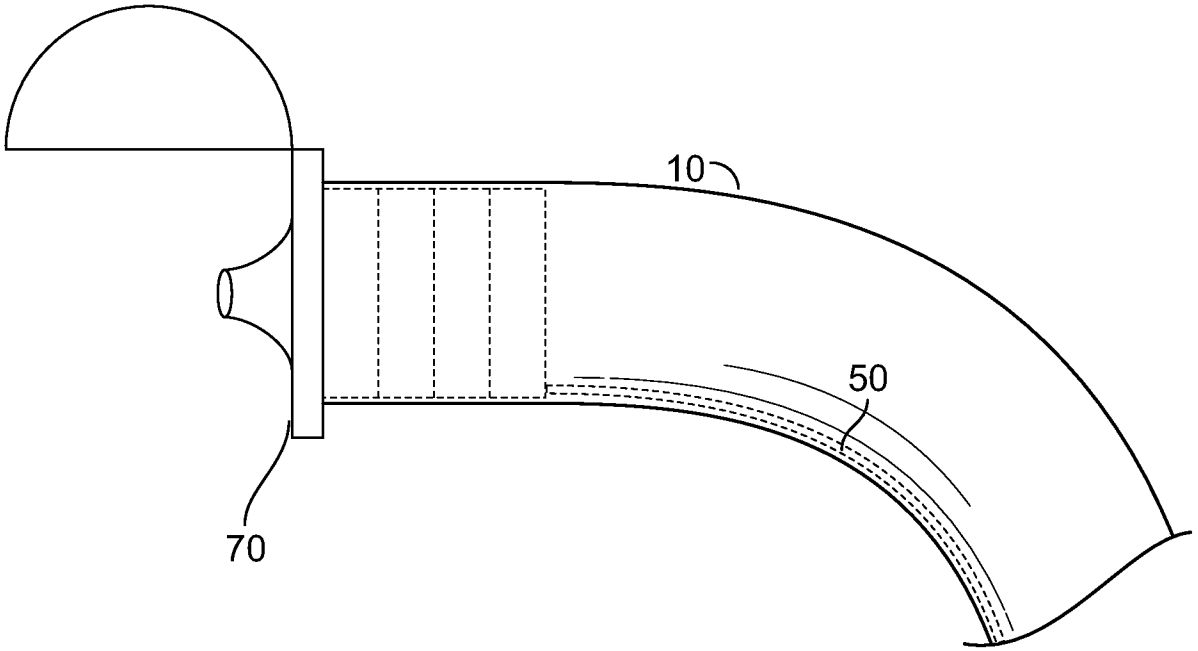
FIG. 10 illustrates an alternative embodiment of the expelling plug of the improved necklace for lotions and gels.

Referring to FIG. 10, an alternative embodiment of the cap of the improved necklace for lotions and gels is shown. Included is body 10, shape-retaining wire 50, and dispensing cap 70.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction, and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A device for storing a liquid by a user, the device comprising:

a tube;

an expelling plug within the tube;

the expelling plug able to move within the tube;

a first dispensing cap affixed to a first end of the tube;

a second dispensing cap affixed to a second end of the tube;

whereby a user can open or close the first dispensing cap or second dispensing cap when dispensing liquid from the tube; the first dispensing cap and the second dispensing cap each further comprising:

a body with a lid, the body and lid connected by a hinge;

a recess within the body, into which a rib fits, the rib holding the lid against the body;

an opening through the body that allows liquid to exit the tube through the body;

whereby the user can squeeze the tube to push the expelling plug, thus forcing liquid out of the tube.

2. The device of claim 1, further comprising:

a shape-retaining wire within a wall of the tube;

whereby the shape-retaining wire allows the user to change a shape of the device, the device then maintaining the shape.

3. The device of claim 2, further comprising:

a first wall thickness and a second wall thickness;

the first wall thickness less than the second wall thickness;

the first wall thickness allowing the tube to be squeezed by the user to dispense lotion;

the second wall thickness including the shape-retaining wire;

whereby the second wall thickness allows for inclusion of the shape-retaining wire, while allowing for the first wall thickness in remaining parts of the tube to permit the user to readily compress the tube.

4. The device of claim 1, the first dispensing cap and the second dispensing cap each further comprising:

a nipple extending from the body;

the nipple affixing the lid to the tube.

5. A portable storage device for carrying gels comprising:

an elongated reservoir with internal moveable plug;

the elongated reservoir formed from a compressible material that a user can squeeze to deform;

a first reservoir within the elongated reservoir, formed on a first side of the internal moveable plug;

a second reservoir within the elongated reservoir, formed on a second side of the internal moveable plug;

a first dispensing cap affixed to a first end of the elongated reservoir;

a second dispensing cap affixed to a second end of the elongated reservoir; the first dispensing cap and the second dispensing cap each further comprising:

a body with a lid, the body and lid connected by a hinge;

a recess within the body, into which a rib fits, the rib holding the lid against the body;

an opening through the body that allows gel to exit the elongated reservoir through the body;

whereby a user can open or close the first dispensing cap or second dispensing cap when dispensing gel from the elongated reservoir;

whereby compression of the elongated reservoir near the internal moveable plug causes motion of the internal moveable plug, thus forcing gel out of the elongated reservoir.

6. The device of claim 5, further comprising:

a shape-retaining wire within a wall of the elongated reservoir;

whereby the shape-retaining wire allows a user to change a shape of the device, the device then maintaining the shape.

7. The device of claim 6, the elongated reservoir further comprising:

a first wall thickness and a second wall thickness;

the first wall thickness less than the second wall thickness;

the first wall thickness allowing the elongated reservoir to be squeezed by a user to dispense lotion;

the second wall thickness including the shape-retaining wire;

whereby the second wall thickness allows for inclusion of the shape-retaining wire, while allowing for the first wall thickness in remaining parts of the elongated reservoir to permit a user to readily compress the elongated reservoir.

8. The device of claim 5, the first dispensing cap and the second dispensing cap each further comprising:

a nipple extending from the body;

the nipple affixing the lid to the elongated reservoir.

9. A wearable lotion dispenser comprising:

a shape-retaining wire;

a reservoir with a first wall thickness and a second wall thickness;

the first wall thickness less than the second wall thickness;

the first wall thickness allowing the reservoir to be squeezed by a user to dispense lotion;

the second wall thickness including the shape-retaining wire;

an expelling plug within the reservoir;

a first dispensing cap affixed to a first end of the reservoir;

a second dispensing cap affixed to a second end of the reservoir; the first dispensing cap and the second dispensing cap each further comprising:

a body with a lid, the body and lid connected by a hinge;

a recess within the body, into which a rib fits, the rib holding the lid against the body;

an opening through the body that allows lotion to exit the reservoir through the body;

whereby a user can open or close the first dispensing cap or second dispensing cap when dispensing lotion from the reservoir;

whereby the user can squeeze the reservoir to move the expelling plug, thus causing lotion to be dispensed.

10. The wearable lotion dispenser of claim 9, wherein:

the shape-retaining wire is within a wall of the reservoir;

whereby the shape-retaining wire allows a user to change a shape of the wearable lotion dispenser, the wearable lotion dispenser then maintaining the shape.

11. The wearable lotion dispenser of claim 9, the first dispensing cap and the second dispensing cap each further comprising:

a nipple extending from the body;

the nipple affixing the lid to the reservoir.

* * * * *